United States Patent [19]

Lecinski, Jr.

[11] Patent Number: 4,805,792

[45] Date of Patent: Feb. 21, 1989

[54] LITTERLESS TAMPER INDICATING CLOSURE

[75] Inventor: Frank H. Lecinski, Jr., Harwood Heights, Ill.

[73] Assignee: Continental White Cap, Inc., Northbrook, Ill.

[21] Appl. No.: 601,207

[22] Filed: Apr. 17, 1984

[51] Int. Cl.[4] ..... B65D 49/12

[52] U.S. Cl. ..... 215/253; 215/252; 215/258

[58] Field of Search ..... 215/252, 253, 254, 258

[56] References Cited

U.S. PATENT DOCUMENTS

| | | | |
|---|---|---|---|
| 1,908,245 | 5/1933 | Hogg | 215/252 |
| 3,812,991 | 5/1974 | Wurl | 215/252 |
| 3,904,062 | 9/1975 | Grussen | 215/258 X |
| 3,994,409 | 11/1976 | Nightengale, Jr. | 215/258 X |
| 4,557,393 | 12/1985 | Boik | 215/253 |

*Primary Examiner*—Steven M. Pollard
*Attorney, Agent, or Firm*—Charles E. Brown; Paul Shapiro; Charles A. Brown

[57] ABSTRACT

The closure cap is provided with an extension of the skirt thereof with the skirt extension having formed therein lines of weakening and having at a lower end thereof an anchoring band which, when the closure cap is applied to a container neck finish, will permanently anchor the closure cap to the container, thus preventing littering by the separate dispensing of the closure cap. The skirt extension is provided with a line of weakening arrangement which, when a cap portion is removed from the container, will rupture and which will define a tethering strap which permanently retains the cap portion to the anchoring band while permitting any required rotation and axial movement of the cap portion to facilitate cap portion removal and product dispensing.

3 Claims, 1 Drawing Sheet

LITTERLESS TAMPER INDICATING CLOSURE

This invention relates in general to new and useful improvements in closures, and more particularly to a closure which is permanently attached to an associated container neck finish by means of a tether, whereby the closure cannot be disassociated from the container and thus is not subject to individual littering. The closure includes a cap portion having a skirt and a skirt extension which terminates in a lower anchoring band, the skirt extension being provided with an arrangement of weakening lines defining, generally between the skirt and the anchoring band, a tethering strap which is automatically formed when the cap portion is removed from the container. The tethering strap is particularly defined by a plurality of open spaces separated by breakable bridges, which bridges, when broken, forming tamper indicating means.

The cap portion is preferably releasably anchored to the container neck finish by way of screw threads, while the anchoring band has a radially inwardly projecting anchoring means receivable in an annular groove in the container neck finish and engageable behind the shoulder defined by such groove.

In a modified form of weakening line, in lieu of the open spaces and bridges, the wall thickness of the skirt extension may be reduced leaving a thin rupturable band of material. When this band of material is torn in the normal opening of a container, the torn material will also be tamper indicating.

With the above and other objects in view that will hereinafter appear, the nature of the invention will be more clearly understood by reference to the following detailed description, the appended claims, and the several views illustrated in the accompanying drawings.

Figure 1:
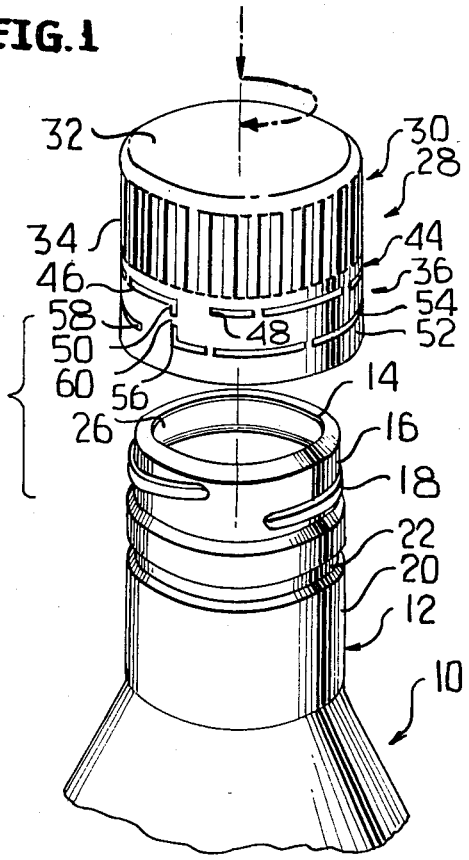
FIG. 1 is a top perspective view of the upper end of a container and having positioned thereabove a tethered closure ready for application.

Referring now to the drawings in detail, it will be seen that there is illustrated a container generally identified by the numeral 10, the container 10 terminating at its upper end in a neck finish 12. The neck finish 12 will have a sealing surface 14 at the free end thereof, and then below the sealing surface 14 the neck finish will be generally cylindrical as at 16 and having projecting therefrom one or more thread elements 18.

Figure 4:
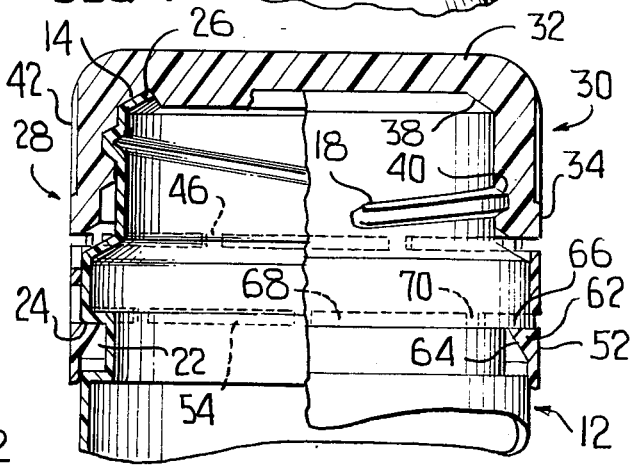
FIG. 4 is an enlarged fragmentary vertical sectional view taken generally along the line 4—4 of FIG. 2, and shows the specific relationship of the closure to the container neck finish.
Figure 3:
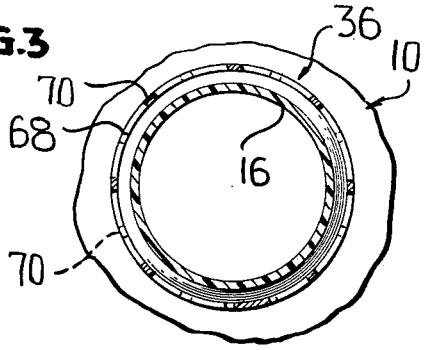
FIG. 3 is a transverse horizontal sectional view taken generally along the line 3—3 of FIG. 2, and shows the specific construction of one line of weakening formed in the closure.

Below the cylindrical surface 16, the neck finish 12 will have a surface 20 of an increased diameter and formed in the upper part of the surface 20 is an annular groove 22 which defines at its upper part a locking shoulder 24 which is best shown in FIG. 4, the sealing surface 14 may be defined by an inturned flange 26.

The container 10 will be closed by a tethered closure generally identified by the numeral 28. The tethered closure 28 includes an upper cap portion 30 which is formed of an end panel 32 and a depending cylindrical skirt 34.

The closure 28 also includes a skirt extension generally identified by the numeral 36.

The cap portion 30 may be of a conventional construction as is clearly shown in FIG. 4, and the end panel 32 may be contoured to define a downwardly facing sealing surface 38 which will mate with the sealing surface 14 as clearly shown in FIG. 4. Further, the inner surface of the skirt 34 may be provided with thread means 40 which cooperate with the thread element 18. In the illustrated embodiment of the invention, the thread element 18 is single and has a peripheral extent less tban 360°. Thus, the thread means 40 may be in the form of a groove formed in the radially inner surface of the skirt 34.

The skirt 34 may also be provided with a roughened or knurled exterior surface 42 to facilitate gripping and rotation of the cap portion 30.

The skirt extension 36 is in the form of a sleeve and is provided with a weakening line arrangement generally identified by the numeral 44. The skirt extension 36 is separated from the skirt 34 by a first line of weakening 46 which extends substantially all of the way around the skirt 34, but has a starting end 48 peripherally spaced from a terminal end 50. The lower end of the skirt extension 36 is in the form of an anchoring band 52 which is separated from the remainder of the skirt extension 36 by a second line of weakening 54. Like the first line of weakening 46, the second line of weakening 54 also does not extend entirely around the skirt portion, but has a starting end 56 which is separated from a terminal end 58. The starting end 56 is generally axially aligned with and axially spaced from the terminal end 50, and these two ends are joined together by an intermediate line of weakening 60.

As is best shown in FIG. 4, the anchoring band 52 is provided with anchoring means in the form of a radially inwardly directed anchoring rib 62 which preferably has a lower and radially inner camming surface 64 and a top surface in the form of an anchoring shoulder 66.

When the closure 28 is applied, as it reaches its position making sealing contact with the sealing surface 14, the anchoring means or rib 62 will have become fully aligned with the groove 22 and will have snapped into the groove with the shoulder 66 being locked beneath the shoulder 24. The anchoring band 52 is thus permanently interlocked with the neck finish 12 of the container 10.

In the primary form of the invention, all of the weakening lines 46, 54 and 60 will be in the form of open spaces 68 interrupted at intervals by bridges 70. Also, it will be seen that the intermediate weakening line 60 is defined by right angle extensions 72, 74 of the adjacent open spaces 68 of the weakening lines 46 and 54 with the extensions 72 and 74 being interrupted by an intermediate bridge 76.

Figure 5:
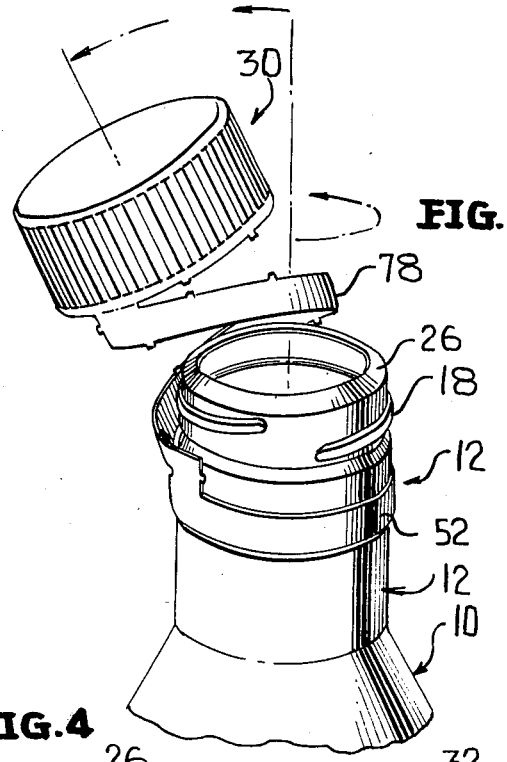
FIG. 5 is a top perspective view showing the closure with the cap portion thereof displaced relative to the container neck finish for the purpose of facilitating pouring of a product from the container.
Figure 2:
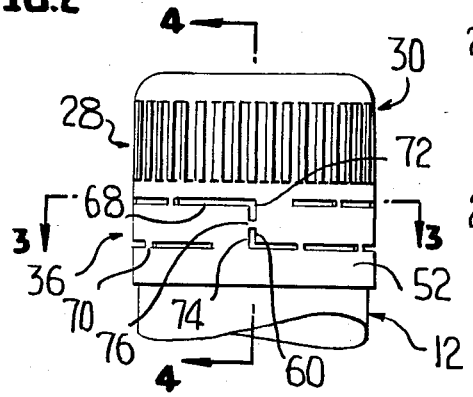
FIG. 2 is a fragmentary elevational view of the assembled closure and container neck finish.

As is best shown in FIG. 5, when the cap portion 30 is rotated to remove the same from the neck finish 12, the bridge 70 and then the bridge 76 will be progressively broken so that when the cap portion 30 is fully removed from the container 10, all of the bridges 70 and 76 will have broken and the cap portion 30 will be anchored to the anchoring band 52 by an elongated tethering strap 78. It will be apparent that the tethering strap 78 permits the unscrewing of the cap portion 30 and also serves permanently to retain the cap portion 30 as part of the container 10. On the other hand, the tethering strap 78 will be of a length to permit the displacement of the cap portion 30 to an out-of-the-way position while the contents of the container 10 may be readily poured through the open mouth thereof defined by the flange 26.

It will also by readily apparent that since the tethering strap 78 has in effect unwound during the removal of the cap portion 30, when the cap portion 30 is to be reapplied, the tethering strap 78 will merely be rewound when the cap portion 30 is reapplied.

Figure 6:
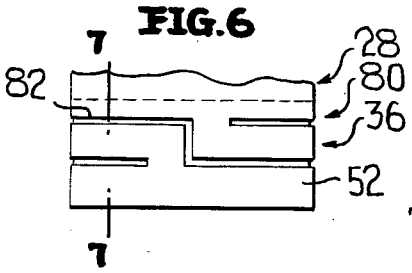
FIG. 6 is a fragmentary elevational view of a lower portion of a modified form of closure using a modified form of weakening line.
Figure 7:
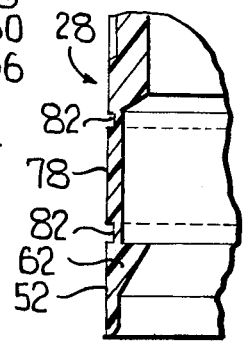
FIG. 7 is an enlarged fragmentary sectional view taken generally along the line 7—7 of FIG. 6, and shows more specifically the details of the weakening line.

In FIGS. 6 and 7 there is illustrated a modified form of the weakening line 44 which is generally identified by the numeral 80. The weakening line 80 differs from the weakening line 44 in that in lieu of the open spaces separated by bridges, the skirt extension 36 is provided with lines of reduced material thickness resulting in thin webs 82, best shown in FIG. 7, defining the tethering strap 78. The modified weakening line arrangement 80 will function in the same manner as the combination of open spaces and bridges of the weakening line arrangement 44, permitting the removal and reapplication of the cap portion 28 while also serving to define tamper indicating means.

Although only two preferred embodiments of the closure cap have been specifically illustrated and described herein, it is to be understood that minor variations may be made in the closure cap without departing from the spirit and scope of the invention as defined in the appended claims.

I claim:

1. A tethered closure cap comprising an upper cap portion including an end panel and a skirt, and a lower tether portion in the form of an extension of said skirt, said skirt extension being joined to said skirt along a first peripheral weakening line having a first starting end spaced from a first terminal end, said skirt extension including a lower anchoring band, a second peripheral weakening line separating said anchoring band from an upper part of said skirt extension, said second peripheral weakening line having a second starting end spaced from a second terminal end, an intermediate weakening line joining said first terminal end to said second starting end, first anchoring means carried by said skirt for releasably securing said cap to a container, and second anchoring means for permanently securing said anchoring means to the same container, all of said weakening lines being in the form of open spaces interrupted by bridges, and said intermediate weakening line being defined by angular extensions of spaces of said first and second weakening lines.

2. A tethered closure according to claim 1 wherein said bridges of said first weakening line are peripherally offset from said bridges of said second weakening line.

3. A tethered closure cap comprising an upper cap portion including an end panel and a skirt, and a lower tether portion in the form of an extension of said skirt, said skirt extension being joined to said skirt along a first peripheral weakening line having a first starting end spaced from a first teminal end, said skirt extension including a lower anchoring band, a second peripheral weakening line separating said anchoring band from an upper part of said skirt extension, said second peripheral weakening line having a second starting end spaced from a second terminal end, an intermediate weakening line joining said first terminal end to said second starting end, first anchoring means carried by said skirt for releasably securing said cap to a container, and second anchoring means for permanently securing said anchoring means to the same container, all of said weakening lines are in the form of open spaces interrupted by bridges, said bridges of said first weakening line being peripherally offset from said bridges of said second weakening line.

* * * * *